US008695362B2

(12) United States Patent
Sunderland

(10) Patent No.: US 8,695,362 B2
(45) Date of Patent: Apr. 15, 2014

(54) REFRIGERATED MERCHANDISER WITH DOOR HAVING BOUNDARY LAYER

(75) Inventor: Ted W. Sunderland, Troy, MO (US)

(73) Assignee: Hussmann Corporation, Bridgeton, MO (US)

( * ) Notice: Subject to any disclaimer, the term of this patent is extended or adjusted under 35 U.S.C. 154(b) by 136 days.

(21) Appl. No.: 13/353,832

(22) Filed: Jan. 19, 2012

(65) Prior Publication Data

US 2013/0187520 A1 Jul. 25, 2013

(51) Int. Cl.

| | |
|---|---|
| ***F24F 3/16*** | (2006.01) |
| ***A47F 3/04*** | (2006.01) |
| ***A47B 96/04*** | (2006.01) |

(52) U.S. Cl.

USPC ..... 62/78; 62/246; 62/248; 62/249; 62/255; 62/256; 312/116; 312/405; 312/406

(58) Field of Classification Search

USPC ..... 62/256, 78, 246, 248, 249, 255; 454/193, 78; 312/116, 405, 406; 361/225, 230; 428/430–432

See application file for complete search history.

(56) References Cited

U.S. PATENT DOCUMENTS

| | | | | |
|---|---|---|---|---|
| 3,105,750 | A * | 10/1963 | Kayko et al. | 96/17 |
| 3,179,482 | A * | 4/1965 | Kassenbeck | 8/444 |
| 3,397,631 | A * | 8/1968 | Simons | 454/190 |
| 4,145,893 | A * | 3/1979 | Vogel | 62/151 |
| 4,245,482 | A | 1/1981 | Abraham | |
| 4,248,015 | A | 2/1981 | Stromquist et al. | |
| 4,265,090 | A | 5/1981 | Abraham | |
| 4,361,012 | A | 11/1982 | Ibrahim | |
| 5,852,284 | A | 12/1998 | Teder et al. | |
| 6,112,546 | A | 9/2000 | Kim | |
| 6,144,017 | A | 11/2000 | Millett et al. | |
| 6,776,822 | B2 * | 8/2004 | Johnson | 96/16 |
| 6,811,883 | B2 * | 11/2004 | Lewiner et al. | 428/421 |
| 7,362,491 | B2 | 4/2008 | Busick et al. | |
| 2004/0003617 | A1 | 1/2004 | Chandler et al. | |
| 2004/0222724 | A1 | 11/2004 | Cording | |
| 2006/0103269 | A1 | 5/2006 | Artwohl et al. | |
| 2007/0188843 | A1 | 8/2007 | Stroumbos et al. | |
| 2007/0259137 | A1 | 11/2007 | Busick et al. | |
| 2008/0098761 | A1 | 5/2008 | Zangari et al. | |
| 2008/0184715 | A1 | 8/2008 | Chen et al. | |
| 2008/0223061 | A1 | 9/2008 | Hixson et al. | |
| 2010/0043472 | A1 | 2/2010 | Iguchi et al. | |

OTHER PUBLICATIONS

PCT/US2012/070479 International Search Report and Written Opinion date mailed Mar. 19, 2013 (9 pages).

* cited by examiner

*Primary Examiner* — Frantz Jules
*Assistant Examiner* — Erik Mendoza-Wilkenfel
(74) *Attorney, Agent, or Firm* — Michael Best & Friedrich LLP

(57) ABSTRACT

A refrigerated merchandiser including a case that has a product display area for supporting food product, an opening for providing customer access to the product display area, and an air passageway in fluid communication with the product display area to direct an airflow into the product display area. The merchandiser also includes a door coupled to the case over the opening and including a charged glass pane, and a charge device in fluid communication with the air passageway to alter the polarity of the airflow to create a charged airflow. The charged glass pane and the charged airflow have the same polarity such that the glass pane is insulated from the charged airflow.

20 Claims, 3 Drawing Sheets

REFRIGERATED MERCHANDISER WITH DOOR HAVING BOUNDARY LAYER

BACKGROUND

The present invention relates to refrigerated merchandisers, and more particularly to refrigerated merchandisers that have doors and a refrigerated airflow directed along the doors.

Refrigerated merchandisers are used by grocers to store and display food items in a product display area that must be kept at a predetermined temperature. These merchandisers generally include a cabinet with an integrated refrigeration unit and have multiple shelves supported within the product display area. Doors positioned along the front side of the merchandiser separate the product display area from the ambient external conditions and allow for consumer access to the contents within. The doors typically include one or more panes of glass configured to minimize heat transfer while providing unimpaired visual access to the product display area.

Due to the conditions of the environment in which they operate, refrigerated merchandisers are susceptible to heat infiltration due to contact between cold air in the refrigerated space and the inner surfaces of the doors. Generally, as air flows downward along the front side of the merchandiser, a small layer of stagnant air forms between the airflow and the inside surface of the doors. This layer of stagnant air, known as a boundary layer of air, is very thin and is ineffective in limiting heat transfer through the doors.

SUMMARY

In one construction, the invention provides a refrigerated merchandiser including a case that has a product display area for supporting food product, an opening for providing customer access to the product display area, and an air passageway in fluid communication with the product display area to direct an airflow into the product display area. A door is coupled to the case over the opening and includes a charged glass pane. The merchandiser also includes a charge device in fluid communication with the air passageway to alter the polarity of the airflow to create a charged airflow. The charged glass pane and the charged airflow have the same polarity such that the glass pane is insulated from the charged airflow.

In another construction, the invention provides a refrigerated merchandiser including a case that has a product display area for supporting food product, an opening for providing customer access to the product display area, and an air passageway including an outlet in fluid communication with the product display area to direct an airflow into the product display area. The air passageway further includes an inlet to receive air from the product display area. A door is coupled to the case over the opening and has a glass pane with a charged conductive layer facing the product display area. The merchandiser also includes a first charge device in fluid communication with the air passageway to alter the polarity of the airflow to create a charged airflow, and a second charge device in fluid communication with the air passageway to alter the polarity of air entering the air passageway. The charged conductive layer and the charged airflow have the same polarity such that the glass pane is insulated from the charged airflow, and the second charge device has a polarity opposite the polarity of the first charge device to neutralize charged air entering the inlet.

In another construction, the invention provides a method of controlling a merchandiser including a case defining a product display area and a door having a glass pane enclosing the product display area. The method includes charging the glass pane, charging an airflow to a polarity that is the same as the polarity of the glass pane, directing the charged airflow into the product display area and across the glass pane, and repelling the charged airflow away from the glass pane as the airflow traverses the product display area to insulate the glass pane from the charged airflow.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
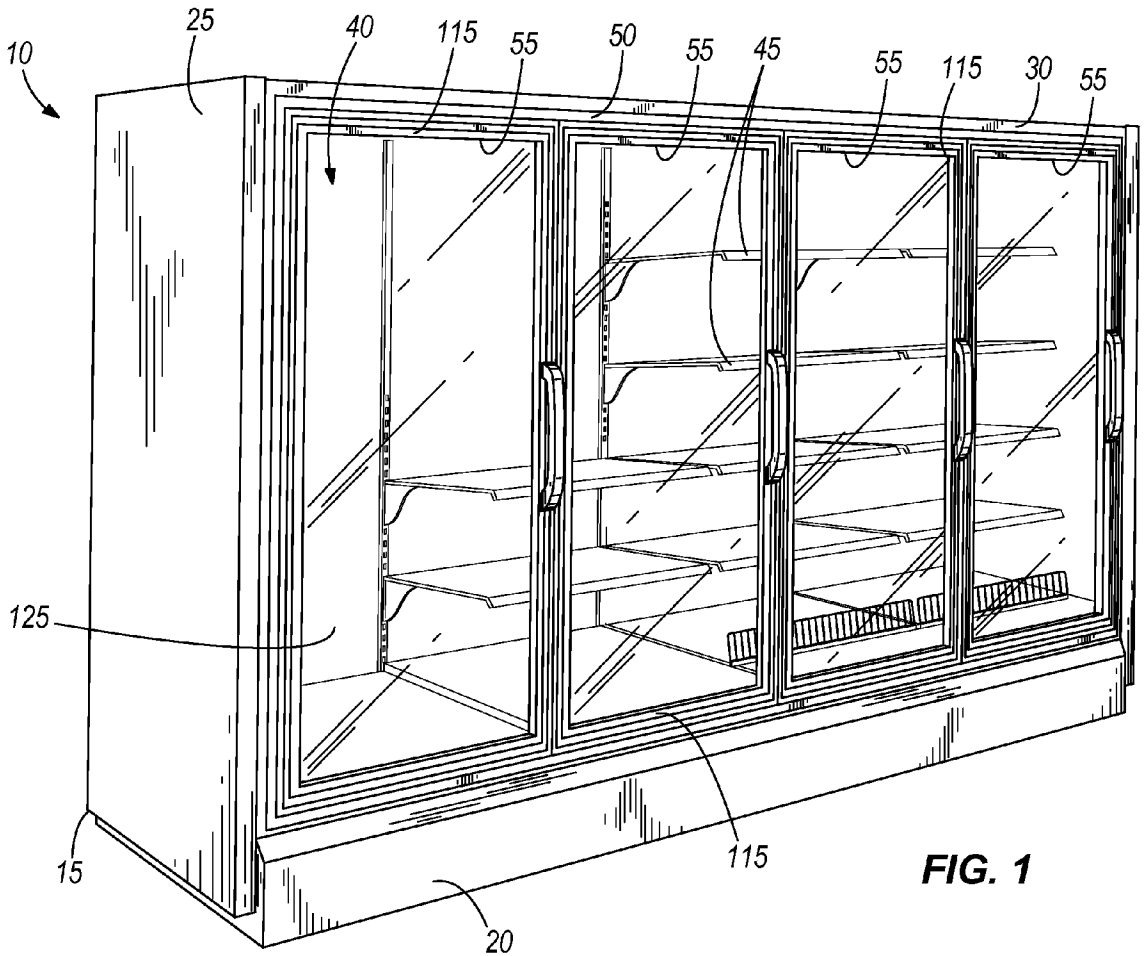
FIG. 1 is a perspective view of a refrigerated merchandiser embodying the present invention.

FIG. 1 shows one construction of a refrigerated merchandiser 10 that may be located in a supermarket or a convenience store or other retail setting (not shown). The refrigerated merchandiser 10 includes a case 15 that has a base 20, side walls 25, a case top or canopy 30, and a rear wall 35. The area partially enclosed by the base 20, the side walls 25, the canopy 30, and the rear wall 35 defines an interior space or product display area 40 that supports food product in the case 15 (e.g., on shelves 45). The product display area 40 is cooled by a refrigeration unit (evaporator 47 shown in FIG. 3), the selection and placement of which will be readily appreciated by those of ordinary skill in this art.

The case 15 also includes a casing or frame 50 located adjacent a front of the merchandiser 10 to support doors 55. In particular, the frame 50 includes vertical mullions 60 that define customer access openings 65 and that support the doors 55 over the openings 65. The openings 65 provide access to food product stored in the product display area 40. The mullions 60 are structural members spaced horizontally along the case 15.

Figure 3:
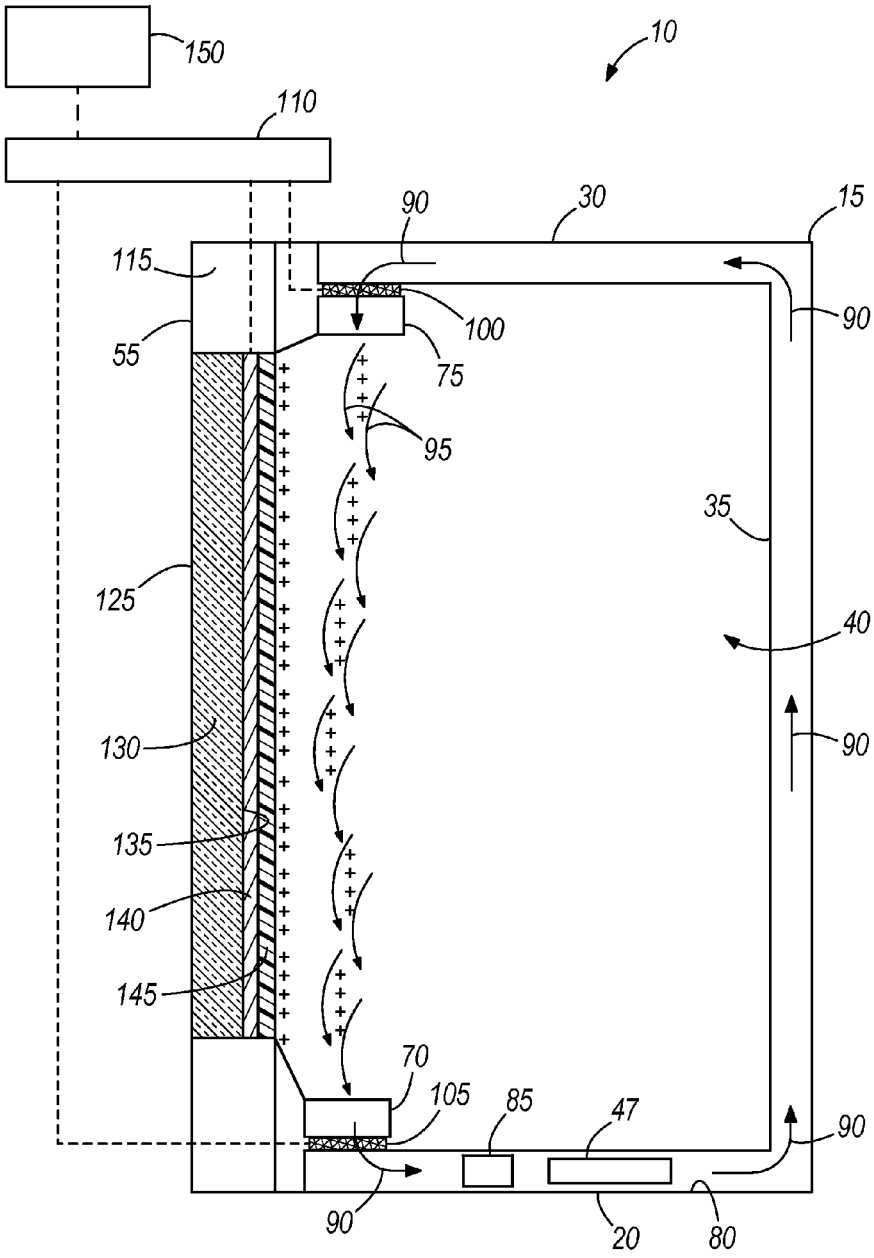
FIG. 3 is a schematic view of the refrigerated merchandiser of FIG. 1.

With reference to FIGS. 1 and 3, the base 20 is disposed substantially below the product display area 40 and can be supported by a floor or support surface (not shown) of the supermarket. The base 20 defines a lower portion of the product display area 40 that can support a portion of the food product in the case 15. As illustrated, the base 20 includes an air inlet 67 defined by an air return plenum 70 located adjacent a lower portion of the customer access openings 65 and in fluid communication with the product display area 40. The canopy 30 is disposed substantially above the product display area 40 and defines an upper portion of the product display area 40 that has an air outlet 72 defined by an air discharge plenum 75. The air discharge plenum 75 is disposed adjacent and in fluid communication with the product display area 40 above the customer access openings 65. In some constructions, the case 15 can be provided with the inlet 67 and the outlet 72 without the air return plenum 70 and the air discharge plenum 75.

The case 15 defines an air passageway 80 that provides fluid communication between the inlet 67 and the outlet 72. As illustrated, the air passageway 80 conducts air substantially horizontally through the base 20 from the air return plenum 70, substantially vertically along the rear wall 35, and substantially horizontally through the canopy 30 to the air discharge plenum 75. FIG. 3 shows that a fan 85 is coupled to the case 15 to generate an airflow 90 within the air passageway 80, although the fan 85 can be located anywhere within the air passageway 80. The inlet 67 and the air return plenum 70 are positioned to receive air from within the product display area 40 in a substantially vertical direction to direct the air into the air passageway 80. Also, the outlet 72 and the air discharge plenum 75 are positioned to discharge the airflow 90 from the air passageway 80 into the product display area 40 adjacent the doors 55 in the form of an air curtain 95.

With reference to FIG. 3, the merchandiser 10 also includes a first charge device 100 and a second charge device 105. The first charge device 100 is disposed in the air passageway 80 and located adjacent the air discharge plenum 75 so that the airflow 90 passes over the first charge device 100. The first charge device 100 is electrically connected to a power source 110 (e.g., a direct current power source) and has a first polarity (e.g., positive charge). The second charge device 105 is disposed in the air passageway 80 and located adjacent the air return plenum 70 so that air passes over the second charge device 105. The second charge device 105 also is electrically connected to the power source 110 and has a second polarity (e.g., negative charge) that is opposite the first polarity.

Generally, the first charge device 100 and the second charge device 105 can take any suitable form to charge or ionize the airflow 90 and to neutralize the airflow 90. As illustrated, the first charge device 100 has a first charged mesh that is located upstream of the air discharge plenum 75 such that the airflow 90 passes through the charged mesh 100 prior to entering the air discharge plenum 75. The second charge device 105 has a second charged mesh is located downstream of the air discharge plenum 75 so that the portion of the air curtain 95 received by the air return plenum 70 flows through the second charged mesh 105. While FIG. 3 shows the first charged mesh 100 near the outlet 72 upstream of the air discharge plenum 75 and the second charged mesh 105 near the inlet 67 downstream of the air return plenum 70, the first charged mesh 100 and the second charged mesh 105 can be located in other areas of the passageway 80. For example, the first charged mesh 100 can be located at the outlet of the air discharge plenum 75, and the second charged mesh 105 can be located at the inlet of the air return plenum 70. The first charged mesh 100 and the second charged mesh 105 can be located anywhere in the case 15 that is in fluid communication with the air passageway 80.

As described in further detail below, the first charge device 100 interacts with and charges or ionizes (e.g., statically charges) the airflow 90 exiting the air discharge plenum 75, and the second charge device 105 interacts with and neutralizes (e.g., statically neutralizes) air entering the air return plenum 70. Generally, statically charged air is formed of air ions with an electric charge due to an imbalance between the number of electrons (or negative charges) and the number of protons (or positive charges). The strength of the charged or ionized airflow 90 (the strength of its electric field) is proportional to the charge provided by the first charge device 100. Similarly, the ability of the second charge device 105 to neutralize the charged or ionized airflow 90 is proportional to the charge of the device 105 and the conductivity of the airflow 90. While the illustrated first and second charge devices 100, 105 have charged meshes, the charge devices 100, 105 can take any suitable form to charge (ionize) and neutralize the airflow 90.

Figure 2:
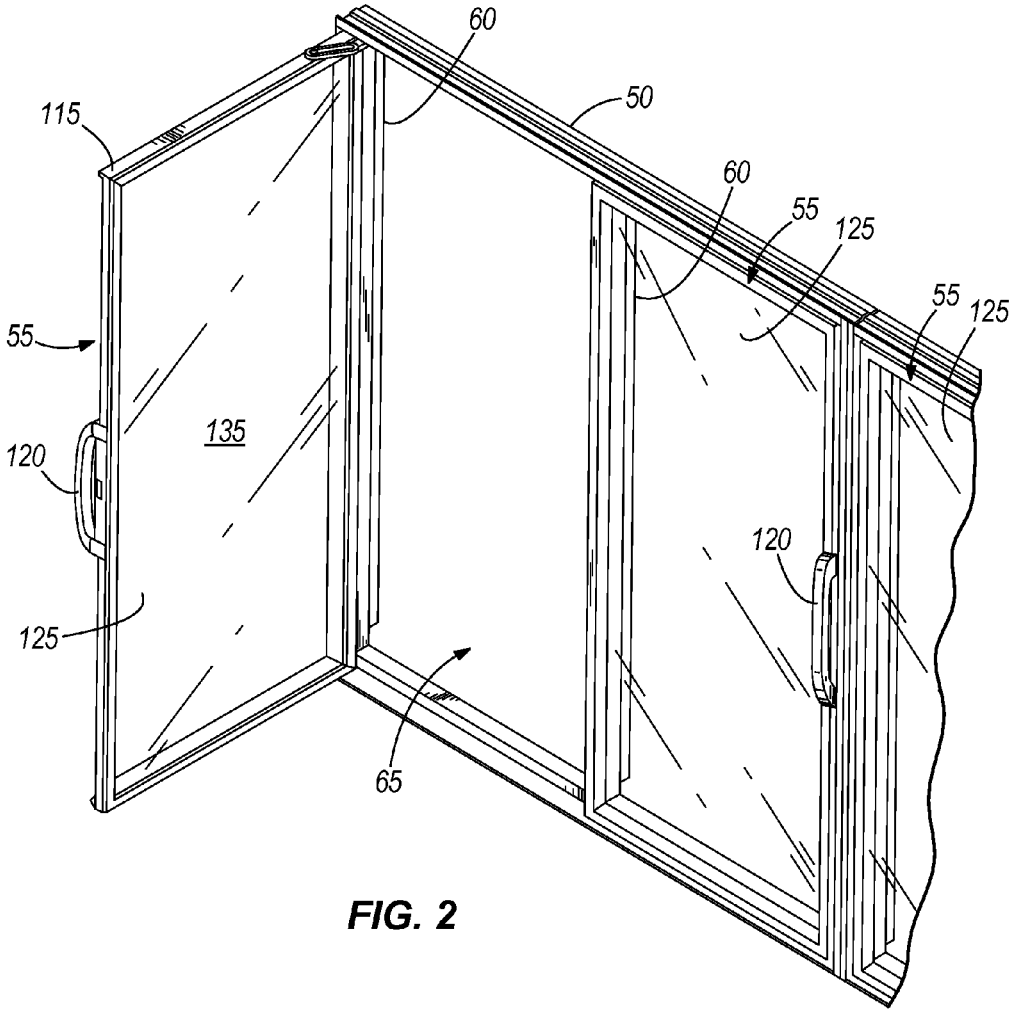
FIG. 2 is a perspective view of doors and a casing of the refrigerated merchandiser of FIG. 1.

Referring to FIGS. 2 and 3, each door 55 is hinged to the frame 50 and has a door frame 115 and a handle 120 for opening and closing the door 55. Each door also has a glass assembly 125 including one or more glass panes 130 that separate the product display area 40 from air in an ambient environment surrounding the refrigerated merchandiser 10. FIG. 3 schematically illustrates the glass assembly 125. The glass pane 130 that is positioned adjacent the product display area 40 includes a surface 135 that faces toward the product display area 40. A conductive layer or coating or film 140 is affixed or applied on the surface 135. The conductive film 140 is electrically connected to the power source 110 to provide a third polarity or static potential (e.g., a positive charge of 2 kV) to the interior side of the glass pane 130. As described in detail below, the third polarity is the same as the first polarity and is opposite the second polarity to insulate the door 55 from the air curtain 95. An insulative film 145 (e.g., dielectric coating) is applied over the conductive film 140 to minimize the possibility of electrical shock to a consumer.

With reference to FIG. 3, the airflow 90 generated by the fan 85 flows through the air passageway 80 and passes over the first charge device 100. The airflow 90 acquires a polarity (e.g., positive potential) from the first charge device 100, and the polarized airflow 90 is discharged from the air discharge plenum 75 generally downward along the interior side of the doors 55. More specifically, the airflow 90 exiting the air discharge plenum 75 in the form of the air curtain 95 takes on the same polarity as the first charge device 100. As illustrated, the air curtain 95 has a positive polarity due to the positive charge associated with the first charge device 100.

The polarized air curtain 95 is repelled by the like-charged surface 135 of the glass pane 130, which forces the air curtain 95 to travel generally downward at a distance from the door 55. Stated another way, the positive polarity of the airflow 90 and the positive polarity or static positive potential of the conductive film 140 substantially increase the thickness or depth of the boundary layer between the air curtain 95 and the glass pane 130 to minimize heat transfer between the air curtain 95 and the door 55.

The thickness or depth of the enhanced boundary layer achieved by the like charges between the air curtain 95 and the glass pane 130 can be controlled electronically by a controller 150 that is in communication with the first and second meshes 100, 105 and the conductive film 140. Generally, the distance at which the air curtain 95 is spaced from the door 55 due to the like charges between them is partially based on the amount of charge applied to the glass pane 130 and the airflow 90. For example, when a relatively weak charge is applied to either or both the airflow 90 and the glass pane 130, the distance between the air curtain 95 and the glass pane 130 will be relatively small compared to the distance achieved by a relatively strong charge applied to either or both the airflow 90 and the glass pane 130.

The distance at which the air curtain 95 is spaced from the door 55 also is based on the angle at which the discharged airflow 90 is directed into the product display area 40. For example, when the air curtain 95 is directed generally away from the doors 55, the air curtain 95 will be minimally repelled by the like charge of the glass pane 130, but the spacing between the air curtain 95 and the doors 55 will be relatively large due to the direction of the air curtain 95. When the air curtain 95 is directed generally parallel to or toward the doors 55, the air curtain 95 will be repelled more strongly by the like charge of the glass pane 130, and the resultant spacing between the air curtain 95 and the doors 55 will depend substantially on the strength of the like charges.

At least some of the polarized air curtain 95 enters the air return plenum 70 to be recycled through the air passageway 80. In doing so, the positively charged in the air return plenum 70 passes over the negatively charged second charge device 105, which neutralizes and accelerates the airflow 90 within the air passageway 80. The airflow 90 is then recirculated and reconditioned within the air passageway 80 prior to discharge through the air discharge plenum 75.

Although the merchandiser 10 is described in detail with regard to the first charge device 100 and the glass pane 130 having positive potentials and the second charge device 105 having a negative potential, it will be appreciated that the polarities of the respective components of the merchandiser 10 can be reversed to insulate the air curtain 95 from the glass pane 130. In other words, the polarities of the first charged 100 and the glass pane 130 can be defined by a negative potential and the polarity of the second charge device 105 can be defined by a positive potential to achieve the insulative spacing between the air curtain 95 and the doors 55 and to neutralize the airflow 90.

The distance between the air curtain 95 and the glass pane 130, which is substantially larger than the boundary layers associated with conventional merchandisers, insulates the glass pane 130 from the airflow 90. The like-charged air curtain 95 and glass pane 130 spaces the airflow 90 away from the door 55 to reduce heat infiltration into the product display area 40 via the glass assembly 125, thus maximizing the insulative properties of the glass assembly 125. Stated another way, the amount of contact between the refrigerated air and the glass surface 135 is minimized by increasing the distance between the airflow 90 and the door 55.

Various features and advantages of the invention are set forth in the following claims.

The invention claimed is:

1. A refrigerated merchandiser comprising:

a case including a product display area for supporting food product, an opening for providing customer access to the product display area, and an air passageway in fluid communication with the product display area to direct an airflow into the product display area;

a door coupled to the case over the opening and including a charged glass pane connected to a power source which provides a potential on the charged glass pane; and a charge device in fluid communication with the air passageway to alter the polarity of the airflow to create a charged airflow, wherein the charged glass pane and the charged airflow have the same polarity such that the glass pane is insulated from the charged airflow.

2. The refrigerated merchandiser of claim 1, wherein the glass pane has a surface facing the product display area and a statically charged conductive layer affixed to the surface and in communication with the charged airflow.

3. The refrigerated merchandiser of claim 2, wherein the statically charged conductive layer includes a conductive film.

4. The refrigerated merchandiser of claim 1, wherein the charge device includes a charged mesh positioned over the air passageway.

5. The refrigerated merchandiser of claim 1, wherein the air passageway has an inlet to receive air from the product display area and an outlet to discharge the airflow into the product display area, and wherein the charge device is positioned adjacent the outlet.

6. The refrigerated merchandiser of claim 5, wherein the charge device is a first charge device, the merchandiser further comprising a second charge device in fluid communication with the air passageway to alter the polarity of the airflow.

7. The refrigerated merchandiser of claim 6, wherein the second charge device has a polarity opposite the polarity of the first charge device to at least one of neutralize and accelerate air entering the air passageway through the inlet.

8. The refrigerated merchandiser of claim 6, wherein the second charge device is positioned adjacent the inlet.

9. The refrigerated merchandiser of claim 6, wherein the first charge device has a positive polarity and the second charge device has a negative polarity.

10. The refrigerated merchandiser of claim 1, wherein the glass pane has a positive static charge and the charge device has a positive charge to positively charge the airflow.

11. The refrigerated merchandiser of claim 10, further comprising a direct current power source in electrical communication with the glass pane and the charge device, and a controller in communication with the power source to selectively vary the amount of charge applied to the airflow and the glass pane to adjust the distance between the airflow and the glass pane.

12. A refrigerated merchandiser comprising:

a case including a product display area for supporting food product, an opening for providing customer access to the product display area, and an air passageway including an outlet in fluid communication with the product display area to direct an airflow into the product display area, the air passageway further including an inlet to receive air from the product display area;

a door coupled to the case over the opening and including a glass pane having a charged conductive layer facing the product display area connected to a power source which provides a potential on the conductive layer;

a first charge device in fluid communication with the air passageway to alter the polarity of the airflow to create a charged airflow; and a second charge device in fluid communication with the air passageway to alter the polarity of air entering the air passageway;

wherein the charged conductive layer and the charged airflow have the same polarity such that the glass pane is insulated from the charged airflow, and wherein the second charge device has a polarity opposite the polarity of the first charge device to neutralize charged air entering the inlet.

13. The refrigerated merchandiser of claim 12, wherein each of the conductive layer, the first charge device, and the second charge device are statically charged.

14. The refrigerated merchandiser of claim 13, further comprising power source in electrical communication with the first charge device, the second charge device, and the conductive layer, and a controller in communication with the power source to selectively vary the amount of charge applied to the airflow and the glass pane to adjust the distance between the airflow and the glass pane.

15. The refrigerated merchandiser of claim 12, wherein the first charge device has a positive polarity and the second charge device has a negative polarity.

16. The refrigerated merchandiser of claim 13, wherein the first charge device includes a first charged mesh positioned adjacent the outlet such that the airflow passes through the first charged mesh, and wherein the second charge device includes a second charged mesh positioned adjacent the inlet such that the air entering the air passageway passes through the second charged mesh.

17. A method of controlling a merchandiser including a case defining a product display area and a door having a glass pane enclosing the product display area, the method comprising:

charging the glass pane by connecting the glass pane to a power source which provided a potential on the glass pane;

charging an airflow to a polarity that is the same as the polarity of the glass pane;

directing the charged airflow into the product display area and across the glass pane; and repelling the charged airflow away from the glass pane as the airflow traverses the product display area to insulate the glass pane from the charged airflow.

18. The method of claim 17, further comprising statically charging the glass pane and the airflow.

19. The method of claim 17, further comprising selectively adjusting the charge on the glass pane and the airflow to change the distance between the glass pane and the airflow.

20. The method of claim 17, further comprising charging a surface of the glass pane and the airflow with one of a positive polarity and a negative polarity;

charging an air inlet of the case with a polarity that is opposite the polarity of the glass pane; and neutralizing air entering the air inlet.

* * * * *